US009115490B2

(12) United States Patent
Hill

(10) Patent No.: US 9,115,490 B2
(45) **Date of Patent: *Aug. 25, 2015**

(54) ATTENUATING ELEMENT

(71) Applicant: HILL INNOVATIONS B.V., Rotterdam (NL)

(72) Inventor: Hans Hill, Capelle A/D Ijssel (NL)

(73) Assignee: HILL INNOVATIONS B.V., Rotterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 14/242,960

(22) Filed: Apr. 2, 2014

(65) Prior Publication Data

US 2014/0314487 A1 Oct. 23, 2014

Related U.S. Application Data

(63) Continuation of application No. 13/582,748, filed as application No. PCT/NL2011/050153 on Mar. 4, 2011, now Pat. No. 8,721,219.

(30) Foreign Application Priority Data

Mar. 5, 2010 (NL) ..... 2004345

(51) Int. Cl.
*E04B 1/84* (2006.01)
*E01F 8/00* (2006.01)
(Continued)

(52) U.S. Cl.
CPC ..... *E04B 1/8404* (2013.01); *E01F 8/0023* (2013.01); *E01F 8/0076* (2013.01); *E02B 3/06* (2013.01); *E02B 3/10* (2013.01); *E02B 3/14* (2013.01); *E04C 1/395* (2013.01)

(58) Field of Classification Search
CPC .... E04B 1/8404; E01F 8/0076; E01F 8/0023; E02B 3/14; E02B 3/06; E02B 3/10; E04C 1/395
USPC ..... 52/144, 608, 561, 574, 603; 405/264, 405/29, 21, 30, 22, 25, 16, 15
See application file for complete search history.

(56) References Cited

U.S. PATENT DOCUMENTS 3,557,669 A 1/1971 Fenton
4,175,888 A 11/1979 Ijima
(Continued)

FOREIGN PATENT DOCUMENTS

DE 19523544 A1 1/1996
FR 2612225 A1 9/1988
(Continued)

OTHER PUBLICATIONS

International Search Report for PCT/NL2011/050152 issued on Jun. 8, 2011.
(Continued)

*Primary Examiner* — James Ference
(74) *Attorney, Agent, or Firm* — Minerva Rivero; David P. Owen; Hoyng Monegier LLP

(57) ABSTRACT

Attenuating element consisting of a head part, neck part and base part. The neck part is narrower compared to the head part and neck parts of adjacent attenuating elements form a continuous channel. Via the head parts, this channel is connected so that the cross-sectional area of the head parts is smaller than the cross-sectional area of the base parts. In this way, a water-control structure, sound-attenuating wall and the like can be provided. Such attenuating elements can be produced in a very simple manner by dividing them vertically and producing each of the vertical parts from concrete in a mould.

21 Claims, 6 Drawing Sheets

(51) Int. Cl.

| | |
|---|---|
| ***E02B 3/14*** | (2006.01) |
| ***E02B 3/06*** | (2006.01) |
| ***E02B 3/10*** | (2006.01) |
| ***E04C 1/39*** | (2006.01) |

(56) References Cited

U.S. PATENT DOCUMENTS

| | | | | |
|---|---|---|---|---|
| 5,087,150 | A | 2/1992 | McCreary | |
| 5,108,222 | A | 4/1992 | Jansson et al. | |
| 5,383,314 | A | 1/1995 | Rothberg | |
| 5,556,230 | A | 9/1996 | Turk et al. | |
| 5,620,280 | A | 4/1997 | Melby et al. | |
| 6,050,044 | A | 4/2000 | McIntosh | |
| 6,050,873 | A | 4/2000 | Reisman | |
| 6,547,487 | B2 | 4/2003 | Yang | |
| 6,588,978 | B2 | 7/2003 | Yang | |
| 6,666,620 | B2 | 12/2003 | Yang | |
| 6,669,403 | B2 | 12/2003 | Clark et al. | |
| 6,719,487 | B2 | 4/2004 | Yukimoto et al. | |
| 7,717,643 | B2 | 5/2010 | Han | |
| 8,721,219 | B2 * | 5/2014 | Hill | 405/25 |
| 2002/0025231 | A1 | 2/2002 | Yang | |
| 2002/0037198 | A1 | 3/2002 | Yang | |
| 2002/0108348 | A1 | 8/2002 | Yukimoto et al. | |
| 2002/0114669 | A1 | 8/2002 | Yang | |
| 2002/0154950 | A1 | 10/2002 | Yang | |
| 2005/0271470 | A1 | 12/2005 | Rytand | |
| 2007/0080478 | A1 | 4/2007 | Reedijk et al. | |
| 2009/0050401 | A1 | 2/2009 | Sanders | |
| 2009/0107059 | A1 * | 4/2009 | Kipp et al. | 52/144 |

FOREIGN PATENT DOCUMENTS

| | | | |
|---|---|---|---|
| JP | H0649517 | U | 7/1994 |
| WO | 03/076727 | A1 | 9/2003 |

OTHER PUBLICATIONS

International Preliminary Report on Patentability for PCT/NL2011/050152 issued on Jun. 11, 2012.

* cited by examiner

ATTENUATING ELEMENT

CROSS REFERENCE TO RELATED APPLICATIONS

This application is a continuation of U.S. patent application Ser. No. 13/582,748 filed on 27 Sep. 2012, which is a National Stage Entry of PCT application number PCT/NL2011/050153 filed on 4 Mar. 2011, which claims priority from Netherlands application number 2004345 filed on 5 Mar. 2010. Both applications are hereby incorporated by reference in their entireties.

BACKGROUND OF THE INVENTION

1. Field of the Invention

The invention relates generally to an attenuating element.

2. Description of the Related Art

An attenuating element of this type can be used to attenuate the action of the waves, for example on water-control structures, such as dykes. In addition, the attenuating element according to the present invention can be used for attenuating sound waves, wherein a number of attenuating elements form a sound-attenuating barrier or wall. Other possibilities to attenuate the energy of waves can be achieved by means of attenuating elements, for example the removal of large quantities of water.

In the prior art, series of blocks which have been placed against one another have been used as attenuating elements which are used for dykes, wherein the upper surfaces of such blocks have been placed in a more or less adjoining manner. It has been found that it is possible to achieve an improvement if apertures are provided on the upper side into which the water can be moved. As a result thereof, the flow of the water flowing onto the dyke is disrupted and the attenuating action is increased.

However, in the prior art this requires highly complex elements which are associated with correspondingly high production costs.

US 2002/0025231 discloses an attenuating element assembly consisting of a series of attenuating elements with a common base part. Such a structure is very difficult to install, can certainly not be handled by hand and does not provide a possibility for modifications to the shape of the body located underneath, such as a dyke body or another wall. Due to the common base part, there is no interaction with the remainder of the dyke.

U.S. Pat. No. 5,556,230 discloses a coastal defence system consisting of a number of elements with narrowed and enlarged parts which are placed against one another in turns. Although this does make it possible to follow the shape of a dyke body, it only achieves limited additional attenuation, if any. Such a structure is only suitable for preventing erosion of material.

All structures of this kind have the drawback that they are so heavy that they cannot be readily installed by hand and, in addition, are very difficult to produce from concrete material. More particularly, they require a very complicated mould, as a result of which it is not possible to produce them at high speed and on a large scale at relatively low cost.

WO 03/076727 discloses an ecological block which can be used on river banks and is provided with cavities which are to be filled with vegetation. The block is substantially rectangular and, in a first embodiment, is substantially flat on two opposite sides. In another variant (FIG. 6), one side thereof is flat and the opposite side is provided with a head part and a base part. It is intended to place the flat side against a wall.

BRIEF SUMMARY OF THE INVENTION

It is an object of the invention to provide an attenuating element by means of which waves, such as water waves or sound waves, can be attenuated in an optimum manner. In addition, it is an object of the present invention to be able to produce such an attenuating element in a simple manner, the latter having a relatively complex shape during operation while installation thereof is in addition facilitated and installation by hand is possible.

This object is achieved by an attenuating element having the features of claim 1.

According to the present invention, a particularly effective attenuation is achieved in that a neck part adjoins the head part. Due to the cross-sectional area being smaller than the base part, the head part is in fluid communication with the neck part, as a result of which the movement path of the medium to be attenuated is disturbed due to the fact that a part of, for example, a wave against a dyke disappears into the neck part via the head part.

According to an advantageous embodiment of the invention, all attenuating elements are substantially identical and are substantially positioned in the same manner, which is in contrast to the structure shown in U.S. Pat. No. 5,556,230.

Due to the use of separate attenuating elements, each having separate base parts, it is possible, by means of the present invention, to achieve an interaction with a layer located underneath.

If the attenuating element according to the present invention is, for example, used on a dyke, a series of attenuating elements can be placed on a filter layer or gravel layer of a dyke. Such a filter layer allows the water to move and also makes it possible to provide the removal of water. However, it is important that such a filter layer also stays in place under rough circumstances, such as significant wave action.

By means of the present invention, it is possible to control the amount of water which flows between adjacent head parts. At first, this can be controlled by determining the interspace between adjacent head parts. The water which subsequently flows along the head part can be removed either by means of a channel which is formed by a number of adjacent neck parts or via openings which are present between the base parts and flow away into the above-described filter layer. By means of the present invention, it is possible to provide an optimum adaptation so that, on the one hand, optimum attenuation of the occurring wave action can be achieved while, on the other hand, damage to the filter layer or other foundation of the dyke body can be prevented.

A particularly simple structure can be achieved by constructing the attenuating element from two attenuating element parts. The attenuating element is preferably divided vertically, that is to say each attenuating element part comprises a head part, a neck part and a base part. The division is preferably in the form of a flat surface. In this way, a simple mould or formwork in combination with a press suffices, with the upper side of the mould or formwork being the dividing plane. This makes it possible to rapidly produce large quantities of attenuating element parts at relatively low costs. These half attenuating element parts can be attached to one another, if desired after production (or during production). To this end, it is possible to use, for example, bonding techniques. However, when installing a series of elements, it is also possible to place the attenuating element parts against one another without being attached to one another.

When made of concrete, the attenuating elements may, for example, be produced using presses. In this case, the moisture content and thus the plasticity of the material to be used are chosen such that, on the one hand, optimum shaping can be carried out and, on the other hand, the residence time in the press mould can be kept as short as possible. In a variant, it is possible to arrange an auxiliary holder made of relatively thin material in the press mould, the shape of such auxiliary holder corresponding to that of the attenuating element, and to press the material of the attenuating element therein. The plasticity is chosen such that it is still not sufficiently dimensionally stable after pressing. By using the auxiliary mould and removing it from the press, the material is given the opportunity to harden further in the auxiliary mould until it is possible to remove the auxiliary mould. The costs of producing such auxiliary moulds are much lower than those associated with an increased residence time in a press.

In a particular embodiment of the present invention, with a number of attenuating elements which are placed against one another, the interspace is achieved in that the neck parts form a channel. In the case of a slanting dyke on which the attenuating elements are placed, water will flow into the neck part via the head part and end up in the channel formed by adjacent neck parts of adjacent attenuating elements and then flow back. On the one hand, this results in a very effective attenuation, while, on the other hand, achieving the removal of water. Preferably, this interspace is also present between the base parts of the attenuating elements. As a result thereof, water can escape, for example, to the dyke body. Preferably, said interspace is significantly smaller than the interspace between the head parts. This prevents a vacuum effect from occurring when the attenuating elements are completely covered with water and the water recedes, which would result in material which is present between adjacent base parts, such as gravel-like material, moving away.

According to the invention, each attenuating element is preferably composed of two attenuating element parts which can be placed against one another, wherein when two such parts are placed against one another along their boundary surface, a head part, neck part and base part are produced.

A corresponding mechanism can be used in order to attenuate sound. In such a case, it is moreover possible to provide the neck part with a sound-attenuating material, such as fibre material.

The head part may have any conceivable shape. The head part may be configured in order to influence the fluid flow to be attenuated. That is to say, by configuring the head part in a certain way, the fluid flow can be deflected, for example, in a certain direction or be divided into substreams.

Thus, when attenuating sound, it may be advantageous to scatter the sound by means of a pointed, spherical or similar shape of the head part. This shape may optionally be symmetrical. The underside of the head part, that is to say the transition to the neck part, may be configured in such a manner that it locks and/or retains sound in the neck part. The present invention makes it readily possible to give the head part a shape such that the impinging fluid as well as sound is deflected in a certain direction.

The base is preferably also configured to be polygonal and more particularly square.

More particularly, the respective polygon has curved, spherical, convex sides. This makes it possible to place adjacent elements at a slight angle to one another, so that curves in a dyke body can be followed. In addition, material will enter the intermediate space which is present between the adjacent bases which results in further stabilization of the elements. For example, due to the square shape, there is more space, compared to a hexagonal shape, for a convex part which improves stability.

If desired, the base parts can be configured to be tapering. The construction comprising element parts of complex shape presented in the present invention makes it possible to produce complex shapes of the attenuating element in an inexpensive manner.

It is indicated that the cross-sectional area of the head part of the attenuating element should be at least 10% smaller than the base part. Preferably, it is not more than 50% smaller than the cross-sectional area of the base part.

The same applies to the head part. When subsequently arranging them in series, for example in order to produce a dyke body, the attenuating elements are preferably configured in such a manner that the head parts, and preferably the base parts as well, lie against one another. This results in a particularly great degree of stability of such a series of attenuating elements.

According to a further advantageous embodiment of the invention, the head is provided with bevelled, rounded edges so that damage is prevented when said head is walked on and when the dyke bodies are walked on or driven on.

The head parts are preferably, and more particularly when used in dyke bodies, configured in such a manner that when a series of attenuating elements are placed against each other, openings are present between adjacent head parts through which water can flow into the neck part located underneath. The size of such openings determines the "counterpressure" which the water encounters when a wave moves across a dyke body. In addition, it is possible to influence the removal of water through such openings by the shape of the neck part. This neck part may be configured to be greater or smaller than the head part. In addition, it is possible to configure the neck part asymmetrically so that a greater cross-sectional area is available in one direction for the flow than in another.

Preferably, the attenuating element is configured in such a manner that there are as many roundings as possible, thus achieving a maximum strength as a result of the absence of sharp edges.

The choice of finish will depend on the application.

When using a dyke body, stability may be increased after a series of attenuating elements has been installed, by introducing a filler material, such as grit. This will preferably be introduced between the base parts.

The above-described attenuating elements can be produced in any conceivable manner.

A particularly expedient production method is to make them from concrete. A formwork in the shape of the attenuating element to be produced is filled with concrete and after the attenuating element has (slightly) hardened, it is removed therefrom.

In addition, it is possible to provide, in particular, the upper side of attenuating elements, that is to say the parts turned towards the surroundings, with a layer which has ecological properties which are better than those of concrete which is used in general. By way of example of such a covering layer, lava stone to which organisms can adhere is mentioned.

It is possible to provide such a layer before pouring the concrete into the mould or formwork. If desired, such a mould or formwork may also be provided with removable partitions, resulting in different spaces which, on one hand, can be filled with the ecologically better type of material and, on the other hand, with the conventionally used concrete material.

In addition, it is possible to enclose environmentally polluting materials in the material from which the elements are produced. It has to be ensured that they cannot leach out.

Sulphur and fly-ash are mentioned by way of example. These materials may be incorporated, for example, in the concrete material used to make an element part.

Due to this production method, it is possible to give the attenuating element any desired shape. Thus, the sides of the base part may be convex.

By means of this production method, but also in any other conceivable way, base parts can be manufactured which are adapted to their use. In addition to the above-described creation of space between the base parts in order to enable the removal of water to the dyke body, it is also possible to configure the base parts in such a manner that they mate, resulting in accurate positioning and in particular the securing thereof.

As has been indicated above, it is possible to construct the attenuating elements from two optionally equal halves or in one part.

In addition to the above-described production technique, it is also possible to achieve a quick production method by means of pressing concrete material. If the attenuating element is made in one piece, a mould consisting of two mutually displaceable mould parts has to be used.

The present invention also relates to a series of attenuating elements as described above in which a channel is delimited by the neck parts.

Such a series preferably comprises at least 100 elements and more particularly at least 1000 elements. As has been indicated above, these attenuating elements are preferably substantially identical. According to a further preferred embodiment, such attenuating elements from one series are oriented substantially in the same way.

If the attenuating elements are used to attenuate sound, they can be placed at an angle and, in an outermost position, even vertically, thus producing a vertical wall.

Further applications of the present invention are the removal of rainwater at tunnels or other locations where large amounts of water may collect.

Depending on the application, a series of attenuating elements may be provided. Thus, these may, for example, be placed loosely against one another in applications in dykes and the like. With other applications, but also when attenuating water, the attenuating elements may be adhesively bonded to one another and, for example, in sound-attenuating applications, a sound-attenuating material may be provided between the various attenuating elements in order to increase the attenuating effect still further. Such an attenuating material may be an elastic type of glue, but may also consist of filler pieces having attenuating properties.

BRIEF DESCRIPTION OF THE DRAWINGS

The features and advantages of the invention will be appreciated upon reference to the following drawings, in which.

DESCRIPTION OF ILLUSTRATIVE EMBODIMENTS

Figure 1:
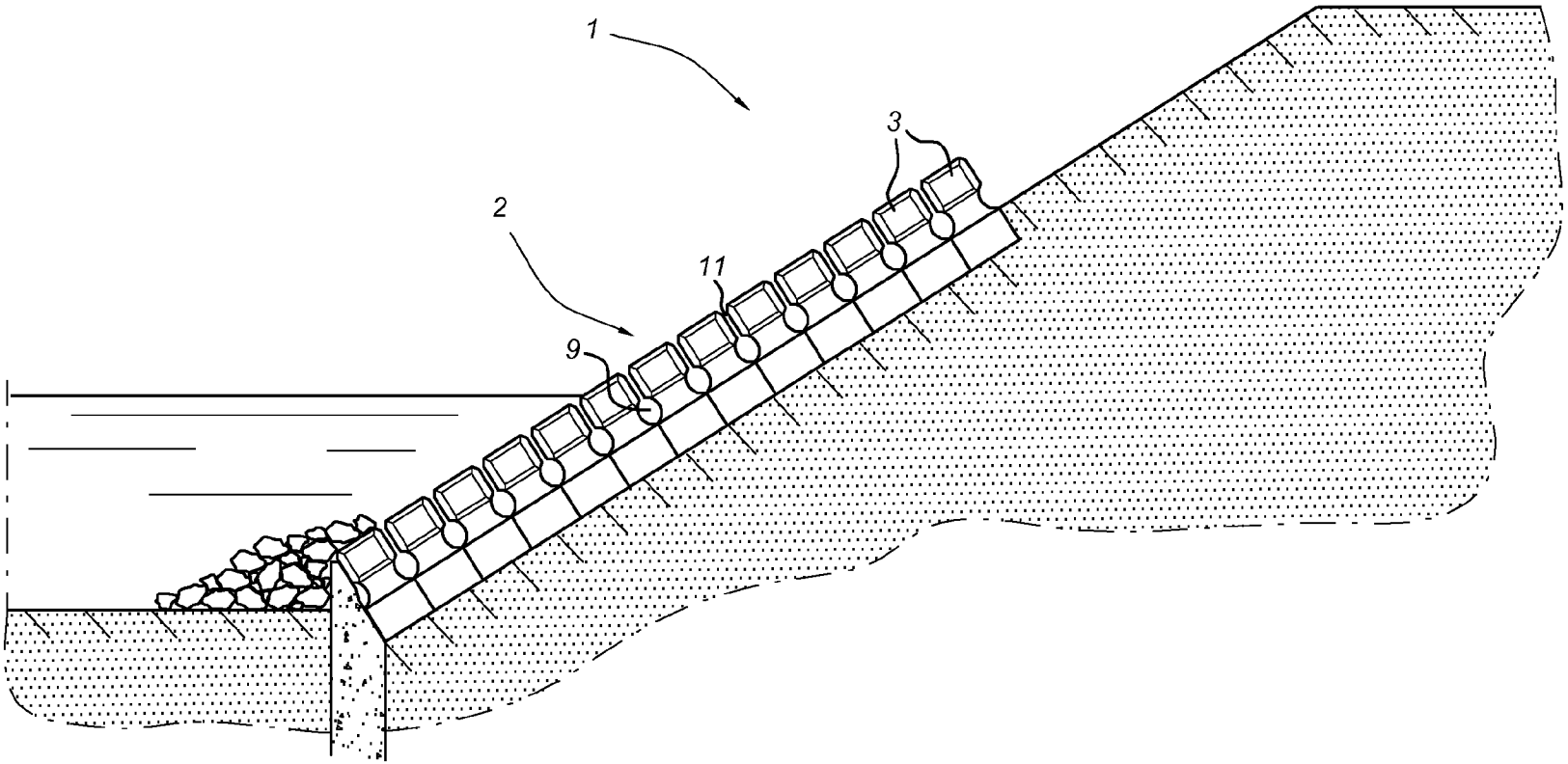
FIG. 1 is diagrammatically shows a water-control structure such as a dyke.

The following is a description of certain embodiments of the invention, given by way of example only and with reference to the drawings. FIG. 1 shows a dyke which is denoted by reference numeral 1. The upper side of this dyke is provided with a reinforcement and/or protection which is denoted by reference numeral 2 in order to prevent the erosion of material. Such reinforcement and/or protection consists of a series of attenuating elements 3 according to the present invention which are placed against one another.

Figure 2:
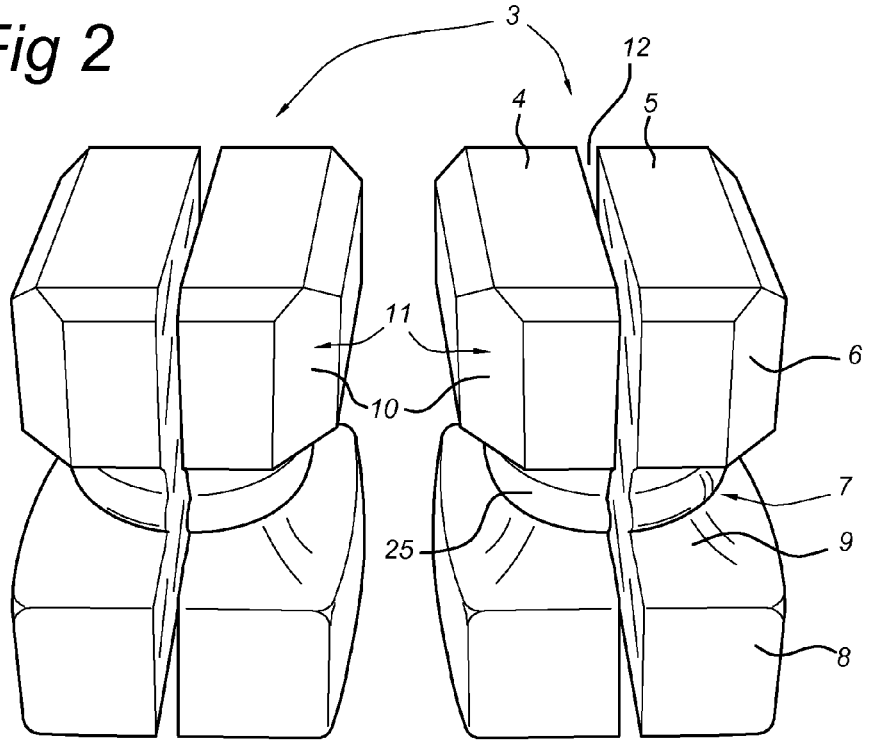
FIG. 2 shows the attenuating elements used in the exemplary embodiment from FIG. 1.

FIG. 2 shows an example of such attenuating elements. As can be seen, each attenuating element 3 consists of two attenuating element parts 4 and 5. For the sake of clarity, they have been shown some distance apart, but in practice the flat dividing planes 12 of each of the attenuating element parts will be placed against one another when constructing a series of attenuating elements 3, as is illustrated in FIG. 1.

Each attenuating element part consists of a head part 6, neck part 7 and base part 8. Preferably, the base part is rectangular and more particularly square. As can be seen in FIG. 2, it is slightly convex in shape. When the parts are placed against one another, it will be possible to pour material into the resulting intermediate space or the latter will automatically be filled with such material when, for example, seawater washes through. The neck part may be provided with a rib 25 in order to increase its strength without significantly influencing the flow surface.

The head part has a polygonal shape with bevels 10. Placing four attenuating elements 3 according to the present invention against one another thus results in an opening 11 towards the neck parts 7. Since the neck parts have a smaller cross-sectional area than the head parts, the neck parts delimit a continuous channel which is denoted by reference numeral 9. The cross-sectional area of the head part is at least 10% and at most 50% smaller than the cross-sectional area of the base part. In practice, the base parts 8 will be placed against one another in accordance with the current regulations. An interspace may be present between the adjacent base parts, depending on the current regulations, in order to allow water to pass through in the downward direction. The Dutch authorities, for example, stipulate that an interspace of at least 8-15% of the total surface area has to be present and that the maximum opening has to be smaller than 5 cm. Of course, it is possible to deviate from this system. When placing base parts against one another, there will always be sufficient space for the water to flow back into the neck part 7 and then flow away via the channel 9 which is formed thereby due to the smaller cross-sectional area of the head parts.

However, it is also possible to produce the attenuating elements in such a manner that when they are placed against one another, the head parts come to lie against each other. Placing both the head parts and the base parts against one another when installing a series of elements results in a very stabile structure. It is possible to provide the head parts with a slight rounding, similar to the base parts. In addition, the base parts may taper from the underside to the upper side thereof, that is to say that if two attenuating elements are placed against one another, an interspace exists between the two which becomes smaller in the downward direction.

The roughness of the surface of the attenuating elements can be selected based on the requirements. In the drawing, the neck parts are circular in FIG. 2. It will be understood that they can also be oval, so that when the attenuating elements are placed against one another, the neck parts in each case delimit a passage conduit which in each case has different cross-sectional dimensions in two directions.

It has been found that this embodiment results in a particularly high attenuation of water waves, as a result of which a dyke body can be made relatively light while still offering sufficient protection.

Figure 3:
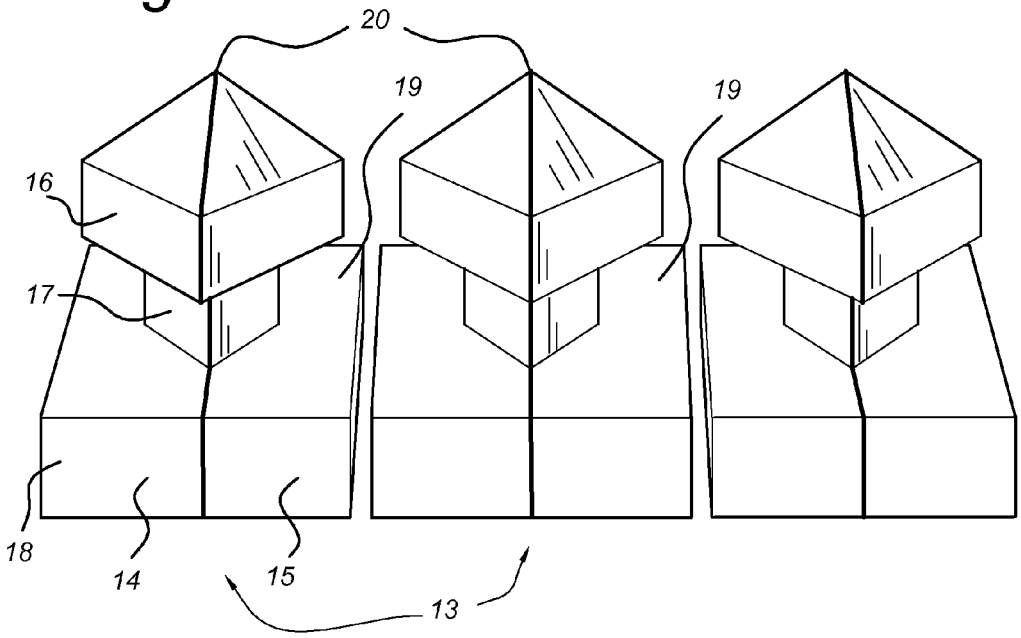
FIG. 3 shows a further embodiment of the attenuating elements for the attenuation of sound.

FIG. 3 shows a further variant of the attenuating element according to the invention which is denoted overall by reference numeral 13. Each attenuating element consists of attenuating element parts 14 and 15. Each attenuating element part consists of a head part 16, neck part 17 and base part 18. Like in the previous embodiment, the cross-sectional area of the head part 16 is smaller than the cross-sectional area of the base part 18. In contrast to the earlier variant, the head part 16 is not flat, but provided with a pointed tip 20.

The neck part and the adjacent attenuating elements together form a channel 19. Optionally, it is possible to provide the neck part with sound-attenuating material, such as mineral wool or the like, when using the attenuating element as a sound barrier.

Figure 4:
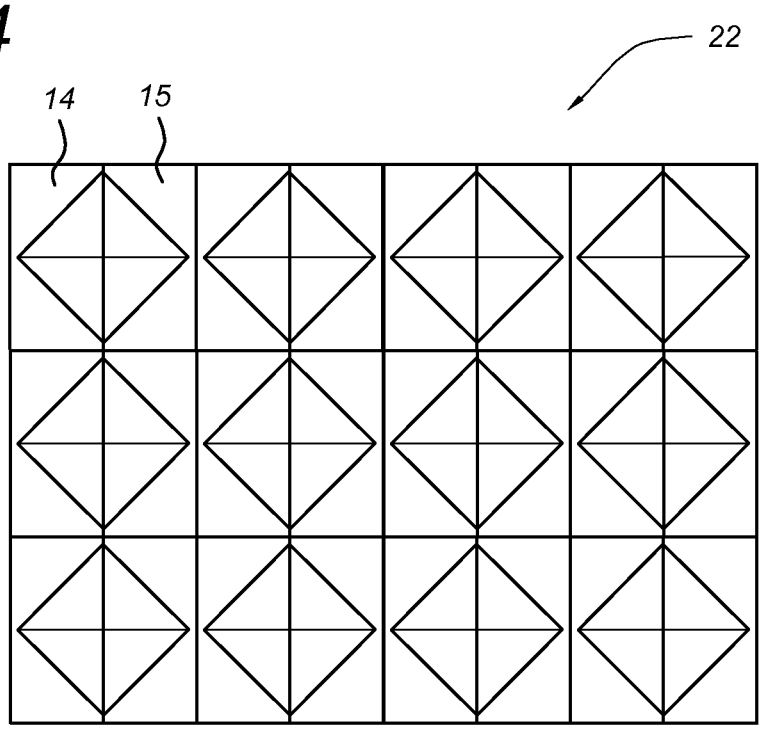
FIG. 4 shows a series of attenuating elements from FIG. 3.

FIG. 4 shows such a use as a sound barrier with the base surface of the base parts being arranged substantially vertically in a series 22. It has been found that a particularly simple and resistant sound barrier can be produced in this manner. In addition it is possible to allow vegetation to grow over said sound barrier. If desired the had parts can rest on one another.

Figure 5:
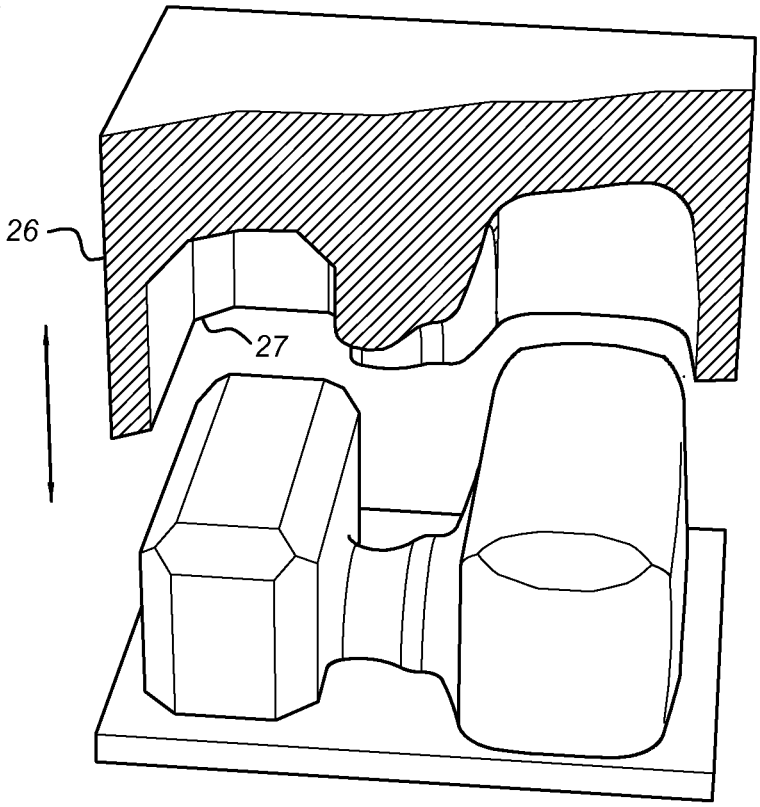
FIG. 5 shows the method of producing attenuating element parts.
Figure 6A:
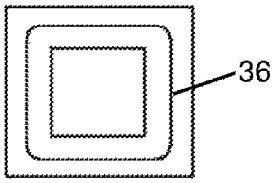
FIGS. 6A-6F show a top view of some shapes of the head part of the attenuating elements.
Figure 6B:
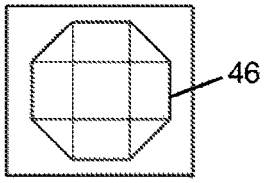
Figure 6C:
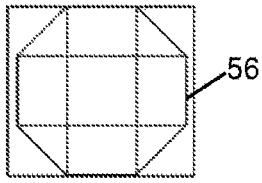
Figure 6D:
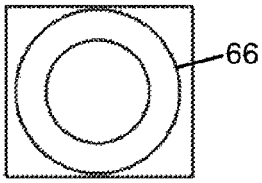
Figure 6E:
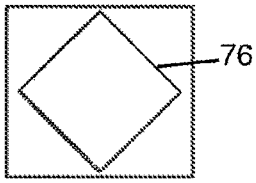
Figure 6F:
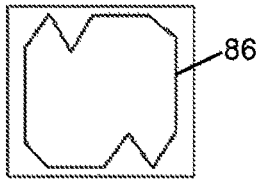

FIG. 5 illustrates an example for the production of the attenuating element part 4, 5 and 14, 15, respectively. A mould or formwork 26 is present in which a mould cavity 27 is provided which corresponds to the shape of the attenuating element part to be produced. The underside comprises a plate which corresponds to the subsequent plane 12.

FIGS. 6A-6F shows a number of variants (in each of FIGS. 6A-6F) of the upper side of the head parts 6 and 16, respectively. Each variant consists of head parts (36, 46, 56, 66, 76 and 86).

Figure 7:
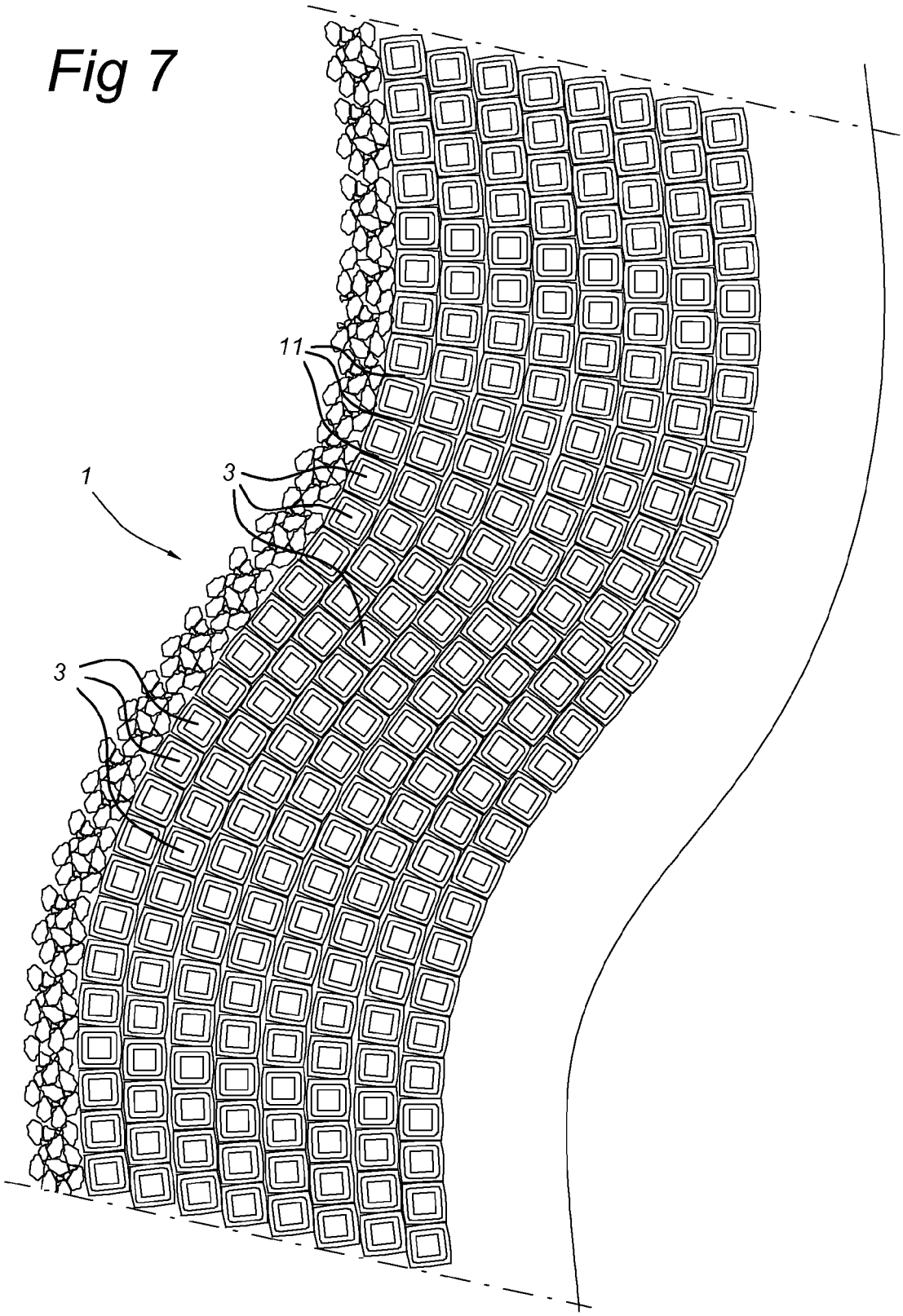
FIG. 7 shows a top view of an example of the positioning of attenuating elements.

FIG. 7 shows a top view of the positioning of a number of attenuating elements as illustrated in FIG. 2. As can be seen, the convex shape of the base parts 8 makes it easy to produce curvatures. By dividing each attenuating element, the weight of each attenuating element part can be kept relatively low. By way of example, a weight of approximately 6 kg is mentioned. Savings in weight of up to 40% can be achieved.

Although this is not shown in FIG. 7, the attenuating elements 3 shown there in each case consist of two attenuating element parts 4 and 5, as is clearly shown in FIG. 2. However, it is also possible to produce the attenuating elements in one part.

First trials have shown that, with respect to a "smooth" slope, a significant attenuation can be achieved, which means that waves reach less far or move at a lower height across the dyke body. The consequence thereof is that, for the same expected wave action, a lower dyke body suffices. Thus, it is possible to render existing dykes resistant to higher waves by installing the above-described attenuating elements.

Figure 8:
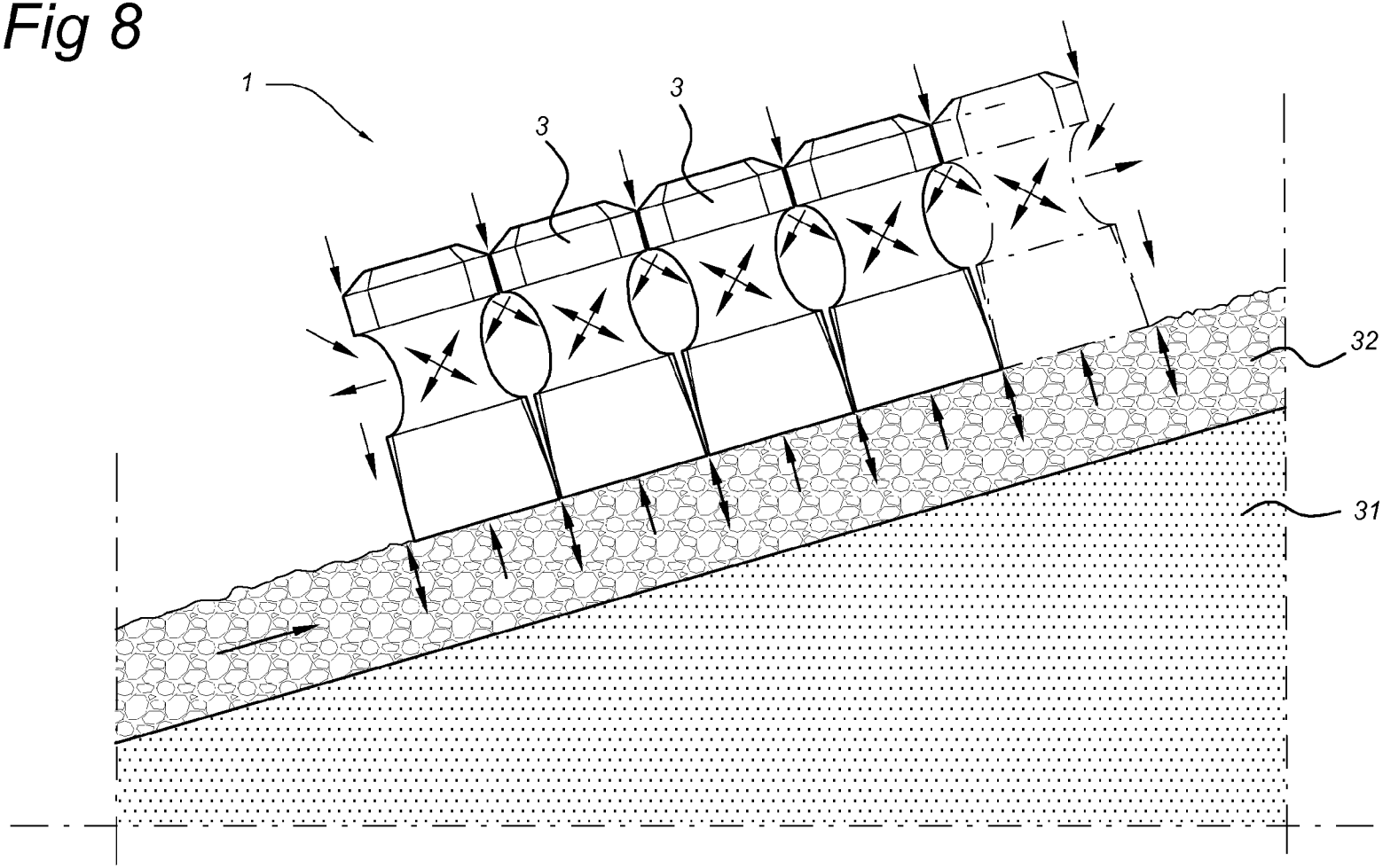
FIG. 8 shows a detail of the water-control structure illustrated in FIG. 1.

FIG. 8 shows a number of adjacent attenuating elements 3 which are installed on dyke 1. This dyke 1 consists of a foundation 31 from any prior art material and a filter layer 32 arranged thereon. Such a filter layer may consist of gravel, for example gravel having a diameter of 5-6 cm. In addition, it is possible to embody the filter layer 32 as a number of filter layers of in each case different gravel or stone sizes. In addition, geotextile cloth may be present therein.

In principle, the filter layer is porous and the various water flows are indicated by means of different arrows. The gravel layer is subjected to the water pressure caused by the wave action. The gravel layer serves to stabilize the dyke body and the attenuating elements 3 illustrated here serve to secure the filter layer. The drawing clearly shows that the amount of water which moves between the head parts is partly removed from the conduits between the neck parts and partly disappears into the gravel layer and is removed via the latter. It is important, on the one hand, for a flow to occur between the neck part and the gravel layer, but on the other hand, it is important that this flow does not become excessively great, thereby causing the gravel layer to lose the supporting strength for the attenuating elements and become instable. By adapting the opening surface in the head part, the dimensions of the neck part and the opening between the adjacent base parts to each other, these flows can be tailored accurately to the maximum wave action to be expected.

It will be understood that the head part, base part and the neck part may have any other shape. What is important, is that a medium can pass from the head part to the neck part for which purpose the head part has a smaller cross-sectional area than the base part. The neck part in turn has a significantly smaller cross-sectional area than the head part in order to form the above-described channel.

In addition, it will be understood that the attenuating element has many applications. In the above description, all this has been illustrated with reference to the side of a dyke body on which the water is present. However, it is also possible to install such attenuating elements on the other side of the dyke body, as a result of which damage to the dyke by piping or vortices can be prevented.

Upon reading the above description, those skilled in the art will immediately be able to think of variants which are obvious and are covered by the scope of the attached claims.

Further modifications in addition to those described above may be made to the structures and techniques described herein without departing from the spirit and scope of the invention. Accordingly, although specific embodiments have been described, these are examples only and are not limiting upon the scope of the invention.

What is claimed is:

1. A series of substantially identical attenuating elements, each of said attenuating elements being placed adjacent to another of said attenuating elements with each said attenuating element oriented substantially in a same way, each said attenuating element comprising:

i) a first half attenuating element part made of concrete, and ii) a second half attenuating element part made of concrete, the first half attenuating element part placed against the second half attenuating element part, each of the first and second attenuating element parts respectively having a half head part, a half neck part, and a half base part that together define a head part, a neck part and a base part of the attenuating element, wherein, the neck part connects the head part to the base part by one end of the neck part connecting to the head part and another end of the neck part connecting to the base part, wherein a maximum cross-sectional area of the neck part as defined by a plane which is perpendicular to a longitudinal axis of the attenuating element is smaller than a maximum cross-sectional area of the base part and than a maximum cross-sectional area of the the head part as defined by planes which are perpendicular to the longitudinal axis of the attenuating element, and in each attenuating element, the head part is positioned over the base part, and each of the half head parts of said attenuating elements share a common first plane, each of the half neck parts of said attenuating elements share a common second plane, and each of the half base parts of said attenuating elements share a common third plane, and wherein, an interspace is formed between each of the head parts of adjacent attenuating elements, and a channel is formed between each of the neck parts of the adjacent attenuating elements.

2. The series of substantially identical attenuating elements according to claim 1, wherein, the first half attenuating element part is lying against the second half attenuating element part along a substantially flat dividing plane;

said base part of each said attenuating element is placed against said base part of another adjacent attenuating element of said attenuating elements, and said neck parts of adjacent attenuating elements delimit a continuous flow conduit.

3. The series of substantially identical attenuating elements according to claim 1, wherein said head part of each said attenuating element is placed against said head part of another adjacent attenuating element of said attenuating elements.

4. The series of substantially identical attenuating elements according to claim 1, wherein the interspace extends towards the neck part of each said attenuating element.

5. The series of substantially identical attenuating elements according to claim 1, wherein, the attenuating elements are arranged to define a sound-attenuating wall, and a base surface of the base part of each said attenuating element is substantially vertical.

6. The series of substantially identical attenuating elements according to claim 5, wherein a sound-attenuating elastic material is present between the base part of the attenuating elements.

7. The series of substantially identical attenuating elements according to claim 1, wherein, the attenuating elements are arranged to define a water-control structure, and a surface of the base of each said attenuating element is arranged at an angle of inclination of less than 45° with respect to a horizontal surface.

8. The series of substantially identical attenuating elements according to claim 7, further comprising:

a filter layer, wherein, the water-control structure is a dyke body, and the attenuating elements are located on the filter layer.

9. The series of substantially identical attenuating elements according to claim 1, wherein the base is tapered.

10. The series of substantially identical attenuating elements according to claim 1, wherein the first and second half attenuating elements are symmetrical.

11. The series of substantially identical attenuating elements according to claim 1, wherein, each first half attenuating element part includes only one half head part, only one half neck parts, and only one half base part, and each second half attenuating element part includes only one half head part, only one half neck part, and only one half base part.

12. The series of substantially identical attenuating elements according to claim 1, wherein an upper side of the head part comprises a fluid-reflecting surface.

13. The series of substantially identical attenuating elements according to claim 1, wherein an upper side of the head part is substantially flat.

14. The series of substantially identical attenuating elements according to claim 1, wherein the head part is a polygonal shape with bevels provided with an opening toward the neck part.

15. The series of substantially identical attenuating elements according to claim 1, wherein, the attenuating elements are arranged to define one of the group consisting of a sound-attenuating element and a water-attenuating element.

16. The series of substantially identical attenuating elements according to claim 15, wherein a sound-attenuating covering is provided around the neck part of said attenuating elements.

17. The series of substantially identical attenuating elements according to claim 1, wherein the cross-sectional area of the base part is a polygon.

18. The series of substantially identical attenuating elements according to claim 17, wherein said base part defines the polygon with convex sides.

19. The series of substantially identical attenuating elements according to claim 1, wherein said neck part has a non-rotationally symmetrical shape.

20. A series of substantially identical attenuating elements, each of said attenuating elements being placed adjacent to another of said attenuating elements with each said attenuating element oriented substantially in a same way, each said attenuating element comprising:

a head part and a base part, a neck part, wherein the neck part connects the head part to the base part by one end of the neck part connecting to the head part and another end of the neck part connecting to the base part and wherein a maximum cross-sectional area of the neck part as defined by a plane which is perpendicular to a longitudinal axis of the attenuating element is smaller than a maximum cross-sectional area of the base part and than a maximum cross-sectional area of the head part as defined by planes which are perpendicular to the longitudinal axis of the attenuating element, wherein:

the head part of each attenuating element lies against the head part of adjacent attenuating elements, the base part of each attenuating element lies against the base part of adjacent attenuating elements, an interspace is formed between each of the head parts of adjacent attenuating elements, and a channel is formed between each of the neck part of the adjacent attenuating elements.

21. The series of substantially identical attenuating elements according to claim 1, wherein at least one of the interspace between adjacent head parts and an interspace between adjacent base parts controls an amount of water that flows between adjacent attenuating elements.

* * * * *